US008276753B2

(12) United States Patent
Garcia De Alba

(10) Patent No.: US 8,276,753 B2
(45) Date of Patent: Oct. 2, 2012

(54) PRODUCT CONTAINMENT, TRANSPORTATION, EXHIBITING, AND DISPENSING PACKAGING STRUCTURE

(75) Inventor: Luis Felipe Rego Garcia De Alba, 16 De Septiembre (MX)

(73) Assignee: Power Retailing Group S.A. de C.V., Mexico (MX)

( * ) Notice: Subject to any disclaimer, the term of this patent is extended or adjusted under 35 U.S.C. 154(b) by 616 days.

(21) Appl. No.: 11/297,904

(22) Filed: Dec. 9, 2005

(65) Prior Publication Data

US 2007/0102315 A1 May 10, 2007

(30) Foreign Application Priority Data

Oct. 25, 2005 (MX) ..... PA/a/2005/011459

(51) Int. Cl.
*B65D 19/00* (2006.01)
*B65D 6/00* (2006.01)

(52) U.S. Cl. ..... 206/386; 206/821; 206/600; 220/7

(58) Field of Classification Search ..... 206/386, 206/600, 597, 736, 586, 453; 229/122.32, 229/919, 120.32, 104; 248/200, 300, 220.1, 248/220, 219; 108/53.1, 53.5, 56.1, 51.11, 108/55.5; D3/304, 305, 313; 220/7; 403/219, 403/382, 403, 300; 473/424; 410/46, 100, 410/116, 98, 106, 107, 117; 362/249; 472/118; 52/39, 289, 702, 701, 712, 714; 211/131.1; *E04C 3/04*

See application file for complete search history.

(56) References Cited

U.S. PATENT DOCUMENTS

| | | | | | |
|---|---|---|---|---|---|
| 1,200,467 | A | * | 10/1916 | Cady | 24/17 R |
| 1,607,711 | A | * | 11/1926 | Walker | 217/69 |
| 2,197,598 | A | * | 4/1940 | Way | 206/451 |
| 2,262,730 | A | * | 11/1941 | Way | 206/451 |
| 2,692,064 | A | * | 10/1954 | Koester | 217/12 R |
| 2,942,883 | A | * | 6/1960 | Moore | 273/26 |
| 3,382,625 | A | * | 5/1968 | Kuss | 52/63 |
| 3,405,665 | A | * | 10/1968 | Slonim | 108/55.1 |
| 3,712,139 | A | * | 1/1973 | Harvey | 73/428 |
| 3,918,234 | A | * | 11/1975 | Weissman | 52/39 |
| 4,193,510 | A | * | 3/1980 | Weston | 220/4.13 |
| 4,261,122 | A | * | 4/1981 | LeVine | 40/711 |
| 4,347,015 | A | * | 8/1982 | Olashaw | 403/219 |

(Continued)

FOREIGN PATENT DOCUMENTS

GB 2232426 A * 12/1990

*Primary Examiner* — J. Gregory Pickett
*Assistant Examiner* — Kaushikkumar Desai
(74) *Attorney, Agent, or Firm* — Fulbright & Jaworski L.L.P.

(57) ABSTRACT

A packaging structure for containing, transportation, exhibition, and dispensing of products at points of sale, of a type including a cubical three-dimensional frame formed by four angular beams in a rectangular or quadrangular arrangement, attached on their lower and upper ends by angular crossbeams, generating empty windows on all its faces; the angular beams and crossbeams are made of compressed rigid cardboard and have two equal arms defining an "L", set with their vortexes facing inside this structure; the structure is set on a base or pallet, that the attachment between the angular beams and crossbeams is made through structural corner joints having an orthogonal square shaped flat surface section with round vortex, an upward projecting and fixating perpendicular tab of a substantially trapezoidal section on each exterior side of the vortex; the tabs and square shaped flat surface include holes through which fixating means are placed in order to attach arms of the beams and crossbeams; a rectangular cavity is made exactly at the exterior corner of the orthogonal square.

4 Claims, 8 Drawing Sheets

U.S. PATENT DOCUMENTS

| | | | | |
|---|---|---|---|---|
| 4,638,941 | A | 1/1987 | Watson | |
| 4,673,092 | A * | 6/1987 | Lamson et al. | 211/188 |
| 4,856,434 | A * | 8/1989 | Smith | 108/53.1 |
| 5,161,692 | A * | 11/1992 | Knierim | 206/586 |
| 5,251,753 | A * | 10/1993 | Pigott et al. | 206/386 |
| 5,307,928 | A * | 5/1994 | Bishop | 206/320 |
| 5,462,193 | A * | 10/1995 | Schoo | 220/652 |
| 6,021,916 | A * | 2/2000 | Stolzman | 220/675 |
| 6,371,299 | B1 * | 4/2002 | Essary | 206/600 |
| 6,814,529 | B2 * | 11/2004 | Junge | 410/46 |
| 6,925,943 | B2 * | 8/2005 | Salmanson et al. | 108/55.1 |
| 6,971,768 | B1 * | 12/2005 | Pepito et al. | 362/249 |
| 7,008,330 | B1 * | 3/2006 | Moulder | 472/118 |
| 2001/0009639 | A1 * | 7/2001 | Gunn | 414/286 |
| 2002/0139798 | A1 * | 10/2002 | Logan et al. | 220/7 |
| 2004/0089572 | A1 * | 5/2004 | Takahashi | 206/386 |
| 2004/0104647 | A1 * | 6/2004 | Nemec et al. | 312/201 |
| 2006/0102517 | A1 * | 5/2006 | Chen | 206/600 |

* cited by examiner

PRODUCT CONTAINMENT, TRANSPORTATION, EXHIBITING, AND DISPENSING PACKAGING STRUCTURE

FIELD OF THE INVENTION

This invention refers to the field of packages and packaging materials for different products, particularly to a packaging structure for containment, transportation, exhibition, and dispensing of great volumes of products at points of sale, intended for end consumers; said structure is characterized by being able to contain and exhibit products at points of sale where end consumers may take said products when purchasing them.

BACKGROUND OF THE INVENTION

Currently most industrial products manufactured in large volumes, to be marketed and sold in big shopping centers and self-service stores generally include a primary canister, container, or package containing such products with preset weight or volume, and generally these variables are the due to consumers needs as a result of commercial experience or result of profound marketing studies.

Accordingly products in such primary canisters, containers, or packages have to be stored in other secondary packages or containers containing a set amount thereof in order to facilitate its handling, transportation, and commercialization, then they mat be stowed and placed on pallets so they may be loaded onto transportation means and then unloaded at points of sale, where they have to be un-stowed and removed from such secondary packages or containers to be placed on exhibitors at shopping centers and self service stores, where end consumers takes them when purchasing them.

Structural characteristics of the product itself and those of said secondary packages or containers do not allow stowing, which make transportation means carry low capacity loads, thus increasing transportation costs; in other cases, depending on the type of transportation, forces created during transportation as a consequence of stops, turns, and sudden movements caused by bumps and pot holes, packages tend to move and collapse; hence it is necessary to use a tertiary package with additional packaging material and structural materials in order to protect the product during transportation, which generates even greater usage of materials, higher packaging costs, and higher transportation costs.

Furthermore, most secondary or tertiary containing packages are closed packages, and do not allow showing and exhibiting of products, which makes it strictly necessary to extract contained products upon arrival at the points of sale in order to be placed on shelves and exhibitors specifically designed for such purpose, which requires additional labor for these intermediate operations or stages.

Otherwise, such as in shopping malls and self service stores, individually packaged products are usually set in islands, placed at various levels and piled on the floor, pallet, stand, box or similar devices, requiring a great deal of labor to order, pile, and group products.

Accordingly, the constant need to have safer, trust worthier packages that allow for protection of such products being transported towards end users, as well as the growing need to have bigger packages or bales that allow on one hand to hold the product, and at the same time exhibit said product at points of sale on the other hand, where they may be displayed to end users thus eliminating secondary packages and intermediate operations from packaging at the factory until they reach said points of sale, has generated the development of new packages that strive to fulfill these needs and avoid usage of or additional investment on acquisition of shelves and exhibitors.

Prior art includes various patents protecting and disclosing packaging structures, such as U.S. Pat. No. 5,251,753 Pigot, et al from Oct. 12, 1993, referring to a combined product transporting and exhibiting unit, which includes a number of vertically stacked product containing trays with vertically supported divisions which keep a space between product containers. Under these shipping conditions, the bottom tray is housed and received within a flange that rests on a conventional shipping pallet. However each tray is provided with an individual angulated support member extending between a pair of adjacent vertically separated trays and a beam on each corner extending the entire height of this unit in order to provide additional structural support during shipping only.

The beams on each corner are only used during shipping, and upon arrival to their final destination at points of sale they are removed, providing only structural support for product protection during shipping; however such structure often collapses and bends as has described before.

U.S. Pat. No. 5,161,692 granted to Stanley E. Knierin on Nov. 10, 1992 refers to a container device with open faces, which includes a cover member with an inner division wall that forms cavities that receive corner beams having a lower outer wall in order to tighten and hold the corners of a household appliance. Such cover and corner beams may be used separately at will. This type of structures are designed to ship products only, more specifically devices of larger dimensions such as household appliances, in order to protect and stabilize such devices during their transportation, not for their exhibition at points of sale for other essential products of smaller dimensions.

U.S. Pat. No. 4,638,941 granted to Robert L. Watson on Jan. 27, 1987 refers to a cardboard container for shipping and exhibiting products, comprising of a plurality of product support trays vertically set one on top of the other, where the product on the lower tray supports the next upper product containing tray.

Said corner beams or corner pieces as reinforcing structural elements protecting the products on the above described structures, are made of compressed cardboard; however such compressed cardboard beams have always been used as packaging material and not as exhibitors.

However these described packages face the same transportation drawbacks described above and require a high amount of raw materials as packaging material and structural reinforcing material in order to protect the product, with the problems described before.

Based on the above and cited and described prior art patents, to this date there is still the need for a packaging structure that allows for containment, transportation, exhibition, and dispensing of large volumes of various products, such as the one described herein.

OBJECTIVES OF THE INVENTION

The primary objective of this invention is to make a packaging structure available for containment, transportation, exhibition, and dispensing of large volumes of product, structurally resilient to allow stacking during transportation and most importantly avoid usage of secondary and tertiary packages.

Another objective of this invention is to make such packaging structure available for containment, transportation, exhibition, and dispensing of large volumes of product, further implying great savings in labor and reducing intermediate operations from shipping to points of sale.

Still another objective of this invention is to allow a packaging structure for containment, transportation, exhibition, and dispensing of large volumes of product, further allowing full exhibition of the product from all angles at multiple levels.

Still another objective of this invention is to provide a packaging structure for containment, transportation, exhibition, and dispensing of large volumes of product, further making such contained and exhibited products highly attractive for end users at points of sale in self service stores.

Still another objective of this invention is to allow such packaging structure for containment, transportation, exhibition, and dispensing of large volumes of product to further have a large load capacity, and also keep products from falling during loading and unloading procedures.

Still another objective of this invention is to make such packaging structure available for containment, transportation, exhibition, and dispensing of large volumes of product that will also be economical, ecological, and partially biodegradable.

Still another objective of this invention is to make such packaging structure available for containment, transportation, exhibition, and dispensing of large volumes of product that will also able to be assembled and disassembled.

Still another objective of this invention is to make such packaging structure available for containment, transportation, exhibition, and dispensing of large volumes of product that will also comprise ample and visible areas for diverse advertising.

And all such qualities and objectives that will become apparent based on the general and detailed description of the present invention, supported by the embodiments described herein.

BRIEF DESCRIPTION OF THE INVENTION

Generally, the packaging structure for product containment, transportation, exhibition, and dispensing according to this foregoing invention consists of a substantially cubical three-dimensional frame made of four angular beams spaced between them in a rectangular or quadrangular arrangement, these beams are joined on their lower and upper ends through cornered structural corner joints with angular crossbeams, forming a quadrangular or rectangular perimeter on each face, hence such structure comprises empty rectangular or quadrangular windows on all faces, limited by said angular beams and crossbeams; said beams and crossbeams are made of compressed hard cardboard, and comprise two equal arms that define an "L", and are set with their vortex pointing inside the structure.

This substantially cubical three-dimensional frame rests on a base or may comprise a bottom fixed on the lower angular crossbeams, and may also be placed on a pallet that makes its handling during loading and unloading maneuvers easier during transportation.

The structural corner joint that joins the beams to said angular crossbeams is preferably made of metal, and comprises an orthogonal square shaped flat surface section with a round vortex, each side of the square has a substantially trapezoidal fixating section tab projecting perpendicularly upward; said tabs and said orthogonal square flat surface include holes through which fixating means are housed in order to attach said beams and crossbeams arms.

Each corner of the substantially cubical three-dimensional structure lies said structural corner joint internally trapped between the angular joint beams and crossbeams arms (arms having a terminal cut at a 45° angle) attached through fixating means to both arms of the beams and the exterior faces of said perpendicular upward projecting tabs of said structural corner joint are attached to the inner face of the vertically set arms (arms with straight cuts) on the ends of said joint angular crossbeams; while arms on the end of said beams are set on the inner face of each upward projecting perpendicular tab, such beams are also attached through fixating means across said vertical arms of the beams, generating a firm and resilient attachment which provides greater support and structural resiliency for the three-dimensional structure.

In one embodiment of this invention each cubic and substantially three-dimensional frame comprises at least two exterior product containing and tensing strings on each face projecting from one corner to the opposite one crossing the central section of the empty window at a median height, ends of such strings are attached to the same fixating means that hold beams and crossbeams on each corner of said three-dimensional frame.

In another embodiment of the invention each face of the cubic substantially three-dimensional frame comprises al least a third exterior product containing and tensing string, set horizontally and fixed on opposite angular beams at mid height, either crossing or not on the same intersection point of the two first exterior tensing strings, and attached on its end to other fixating means set on said angular beams.

In another embodiment of the invention each face of the cubic substantially three-dimensional frame comprises al least a fourth exterior product containing and tensing string, set vertically and fixed on opposite angular crossbeams at the middle of their longitudinal section, either crossing or not on the same intersection point of the other exterior tensing strings, and attached on its end to other fixating means set on said angular crossbeams.

Product is laid on beds within this three-dimensional frame, a first bed on the base or bottom covering the entire inner area of such frame, a divisional panel is set on top of said first bed, then a second bed of product is set on said divisional panel and so forth until the entire height of this cubic substantially three-dimensional frame is covered.

In other embodiment of the invention, the cubic substantially three-dimensional frame comprises at least one pair of inner tensing strings at the same height, each string is attached at their ends at a required height on angular beams on opposite corners and crossed between them, which bring structural stability to these beams.

In another embodiment of this invention said cubic substantially three-dimensional frame comprises a par of inner tensing strings between each bed of products, each string being attached at their ends at the required height on angular beams of opposite corners, and crossing each other, divisional panels are then set on these strings in order to reduce weight and keep the immediate lower product bed from supporting all the product from the immediate higher bed, so the higher bed of products is partially supported by said divisional panel and said inner tensing strings.

Ends of said inner tensing strings go through holes made on the angular beams and comprising external washers that keep such holes from getting bigger and said strings' ends are knotted, and therefore tensed.

In yet another embodiment of the invention, each beam comprises a plurality of angular structural corner joints attached with fixating means to the arms of the beams through the perpendicularly upward projecting tabs, hence the square shaped flat surface section is set as support means for the corners of said divisional panels for each bed of stacked products, in order to provide better support thereto in combination with said inner tensing strings. Said plurality of structural corner joints are distributed at different levels, where structural corner joints of each beam match the height of corresponding structural corner joints of the other beams.

In yet another embodiment of this invention, additional angular crossbeams are set between each bed of products, and on top of the inner tensing strings, generating a reinforcing perimeter frame that supports the immediate higher product bed and provide more structural resiliency; said additional angular crossbeams may rest on the inner tensing strings and/or on top of the structural corner joints of the angular beams, being likewise attached with fixating means to the corresponding beams, and which may receive the divisional panel of each bed.

To allow for a better understanding of the characteristics of the foregoing invention this description includes, as an integral part hereof, drawings with illustrative, and not limitative, character, and are described below with regards to the favorite embodiment of the present invention.

Figure 1:
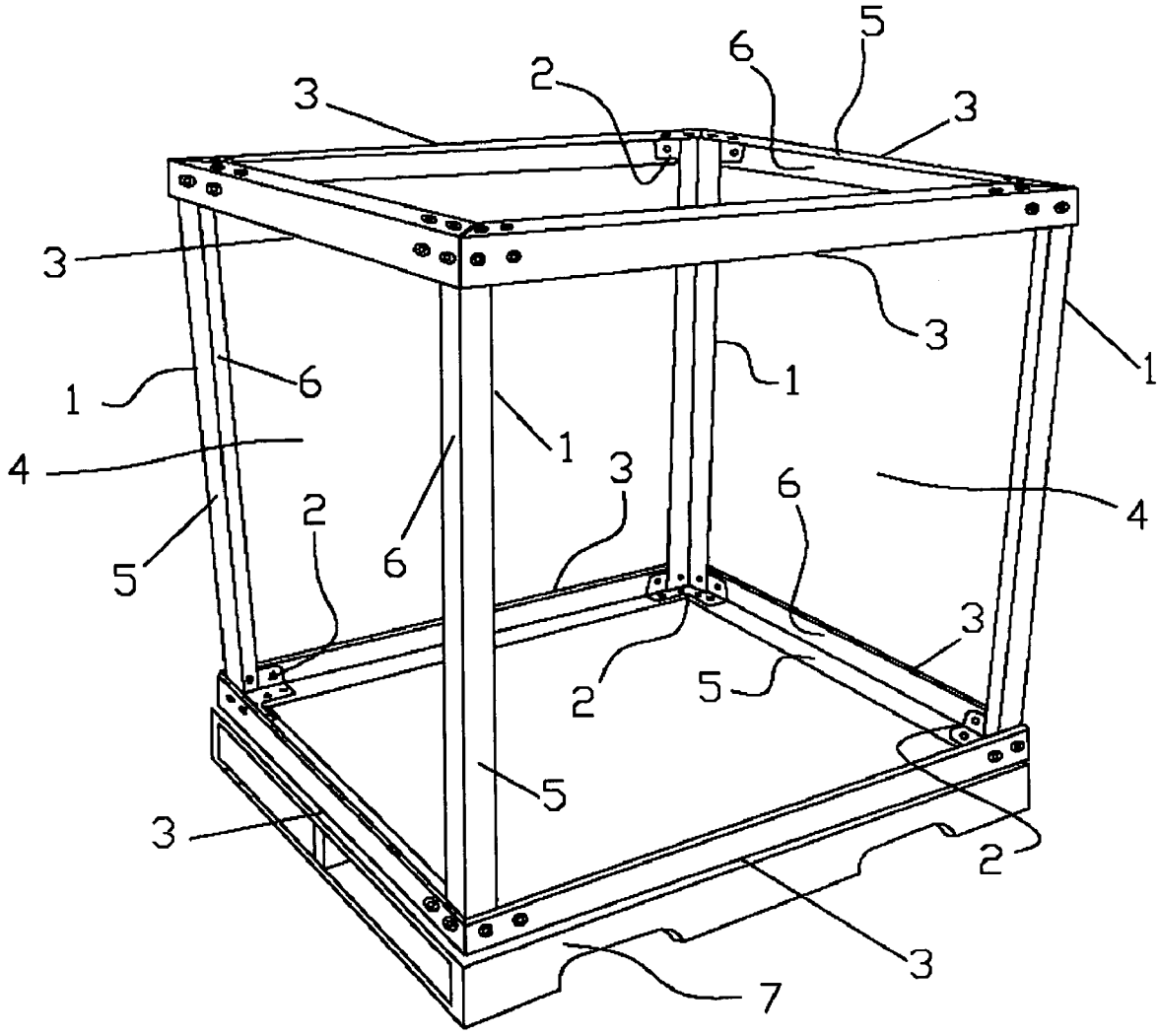
FIG. 1 is a conventional perspective view of the basic embodiment of the packaging structure for containment, transportation, exhibition, and dispensing of products.

A detailed description of some of the embodiments of this translation is given below to provide a better understanding hereof, with reference to the drawings attached hereto with illustrative, not limitative, purposes.

DETAILED DESCRIPTION OF THE INVENTION

Characteristic details of the packaging structure for containment, transportation, exhibition, and dispensing of products are clearly depicted in the following description and in the illustrative drawings attached hereto, with reference numerals used to indicate said parts.

FIG. 1 is a conventional perspective view depicting the basic embodiment of the packaging structure for containment, transportation, exhibition, and dispensing of products. In said Figure, the package consists of a substantially cubical three-dimensional frame made of four angular beams 1 spaced between them in a rectangular or quadrangular arrangement, these beams are joined on their lower and upper ends through structural corner joints 2 with angular crossbeams 3, forming a quadrangular or rectangular perimeter on each face, hence such structure comprises empty rectangular or quadrangular windows 4 on all faces, limited by said angular beams 1 and crossbeams 2; said beams and crossbeams are preferably made of compressed hard cardboard, and comprise two equal arms 5 and 6 that define an "L", and are set with their vortex pointing inside the structure.

This substantially cubical three-dimensional frame rests on a base or pallet 7 and may comprise a bottom that may be fixed on the lower angular crossbeams 3 to make its handling easier during loading and unloading maneuvers during transportation.

Figure 2:
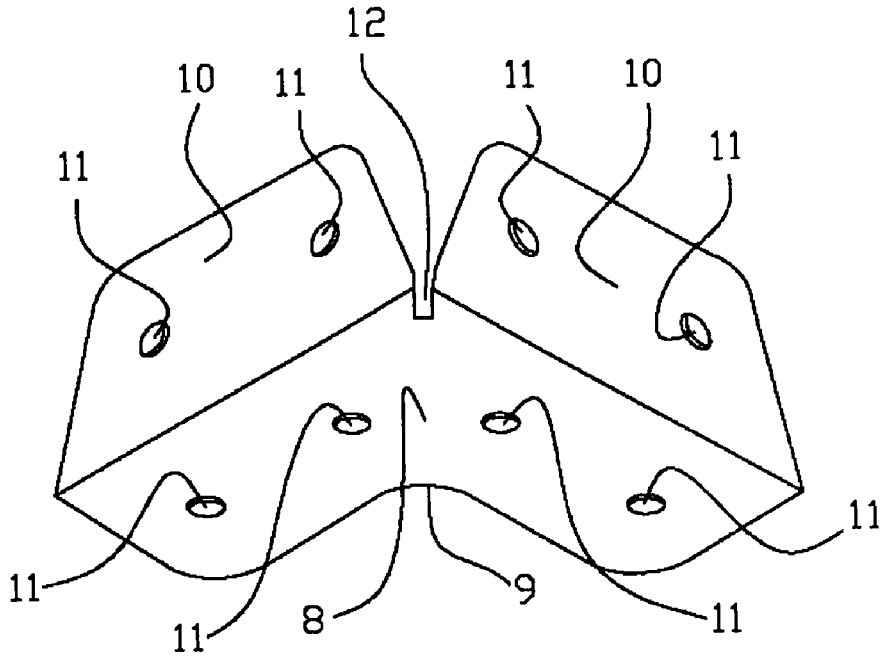
FIG. 2 depicts a conventional perspective view of a structural corner joint as attachment of angular beams and crossbeams of the packaging structure as a substantially cubical three-dimensional frame, and as means of support for corners of divisional panels of contained product beds.

With reference to FIG. 2, each structural corner joint 2 that joins the beams and crossbeams of the packaging structure in a substantially cubical three-dimensional frame configuration comprises an orthogonal square shaped flat surface section 8 with a round vortex 9, each exterior side of the orthogonal square 8 has a substantially trapezoidal fixating section tab 10 projecting perpendicularly upward; said perpendicular fixating tabs 10 and said orthogonal square flat surface section 8 include holes 11 through which fixating means are housed in order to attach said beams and crossbeams arms (not shown).

Figure 6:
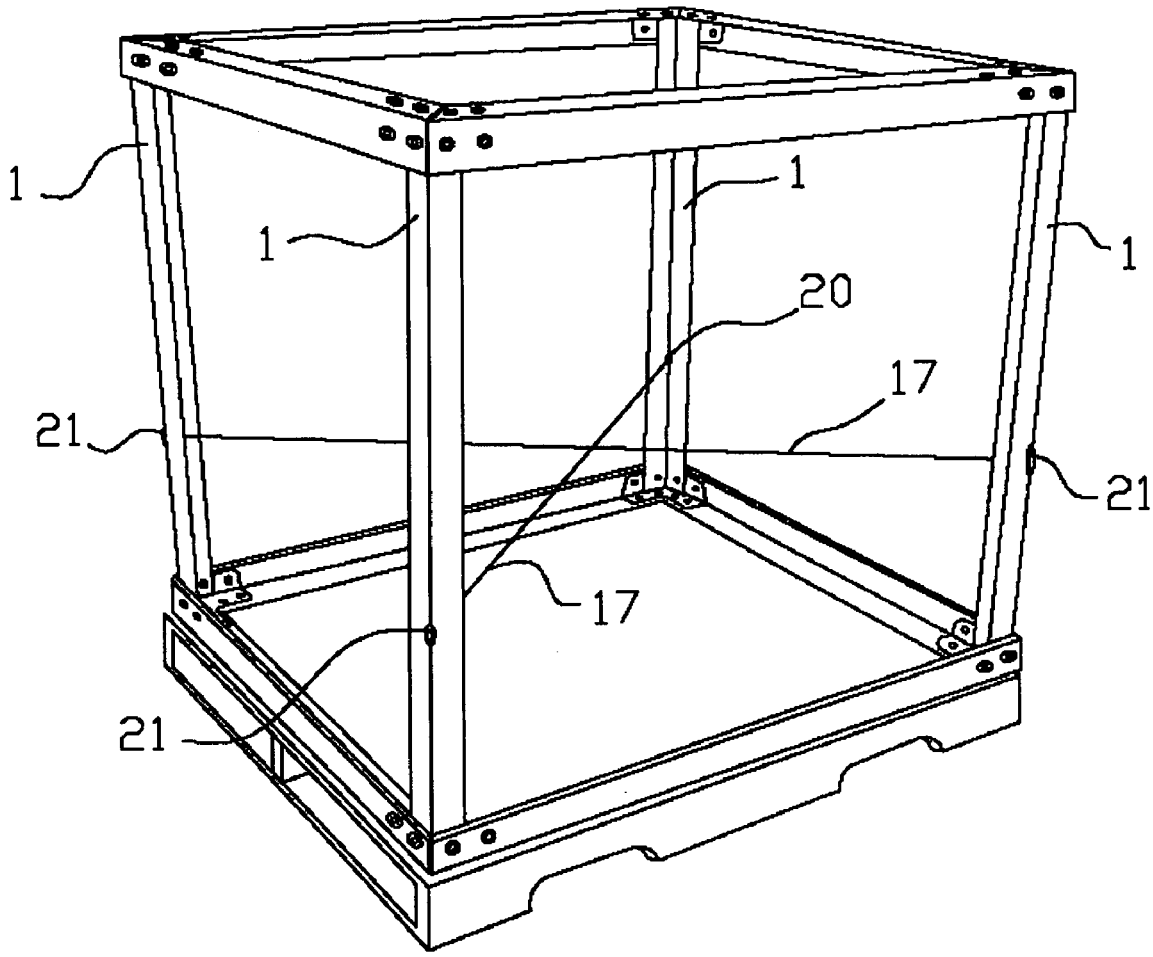
FIG. 6 depicts a conventional perspective view of one embodiment of the packaging structure of this invention incorporating internal tensing diagonal strings.
Figure 7:
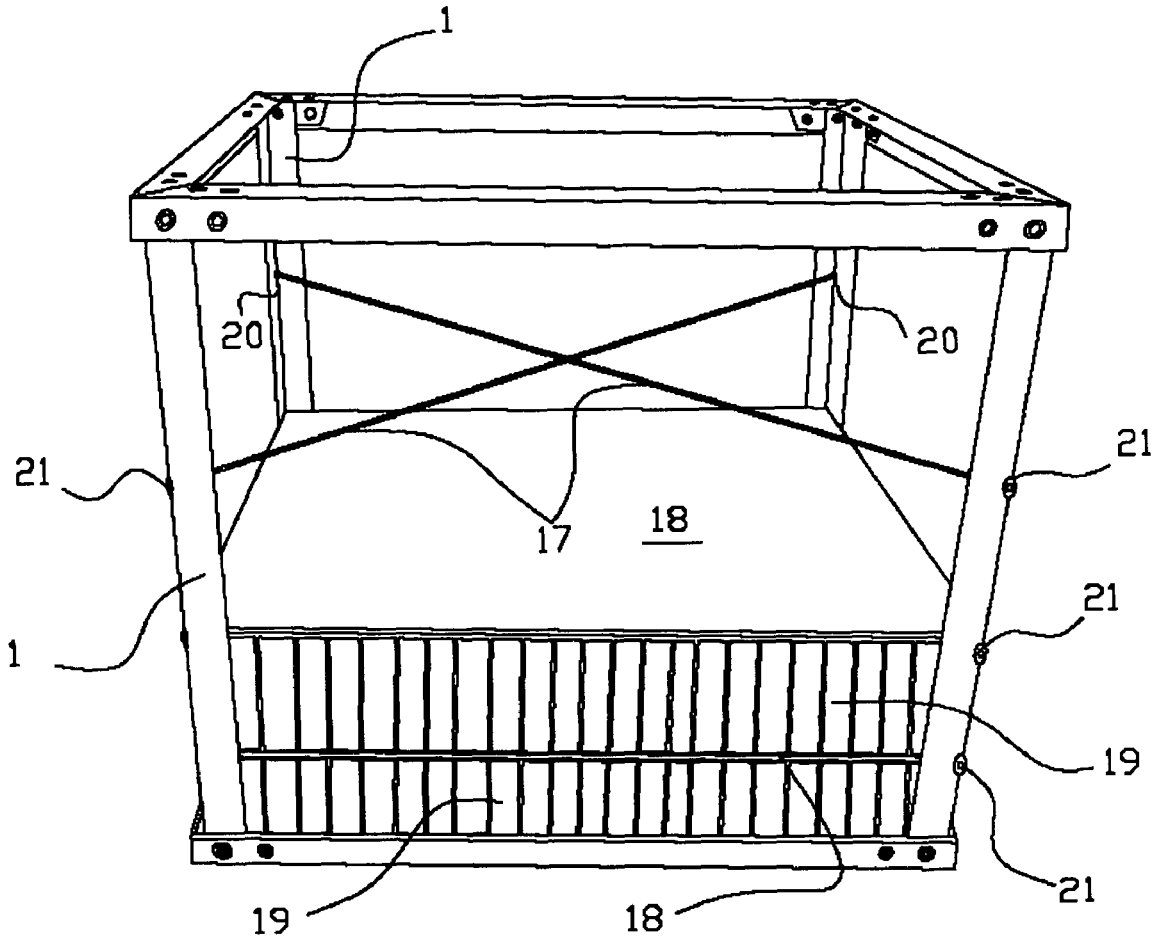
FIG. 7 depicts a conventional perspective view of the package, with product set on various beds, showing divisional panels on top of internal tensing strings.

Between said two upward projecting perpendicular tabs 10 from the exterior sides of said orthogonal square shaped section 8 lies a rectangular cavity 12 made exactly on the outer corner of said orthogonal square to receive and hold ends of said inner tensing strings (not shown) described in FIGS. 6 and 7.

Figure 3:
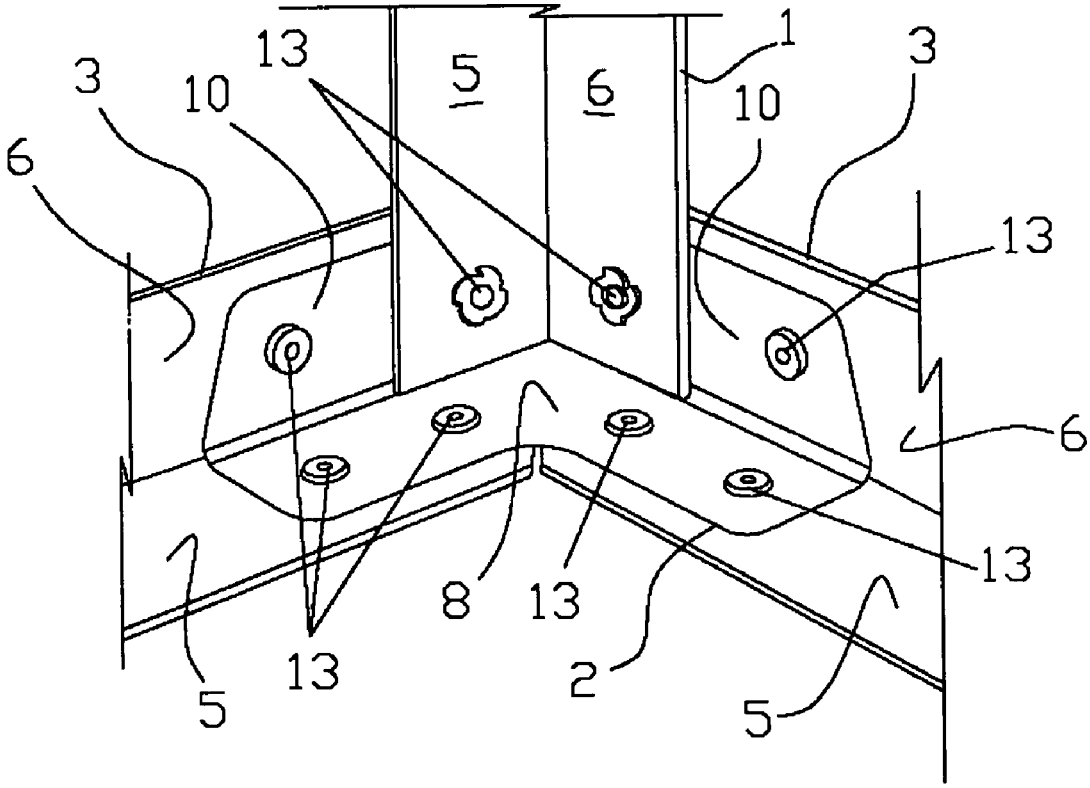
FIG. 3 depicts a conventional perspective detailed view of the attachment of angular beams and crossbeams with the structural corner joint, in each corner of the substantially cubical three-dimensional frame of said package.

With reference now to FIG. 3 that depicts a conventional perspective view details of the attachment of angular beams and crossbeams with the structural corner joint, in each corner of the substantially cubical three-dimensional frame of said package. In said Figure the exterior face of the orthogonal square shaped surface 8 of the structural corner joint 2 makes contact with the inner faces of arms 5 set horizontally from ends of the adjoining angular crossbeams 3 (arms 5 having a terminal cut at a 45° angle) attached through fixating means 13 to both arms of the beams 3 and the exterior faces of said perpendicular upward projecting tabs 10 of said structural corner joint 2 are attached to the inner face of the vertically set arms 6 (arms with straight cuts) on the ends of said joint angular crossbeams 3; while arms 5 and 6 at ends of angular beams 1 are set on the inner face of each upward projecting perpendicular tab 3, such beams are also attached through fixating means 13 across said vertical arms 6 of the crossbeams, generating a firm and resilient attachment which provides greater support and structural resiliency for the structure.

Figure 4:
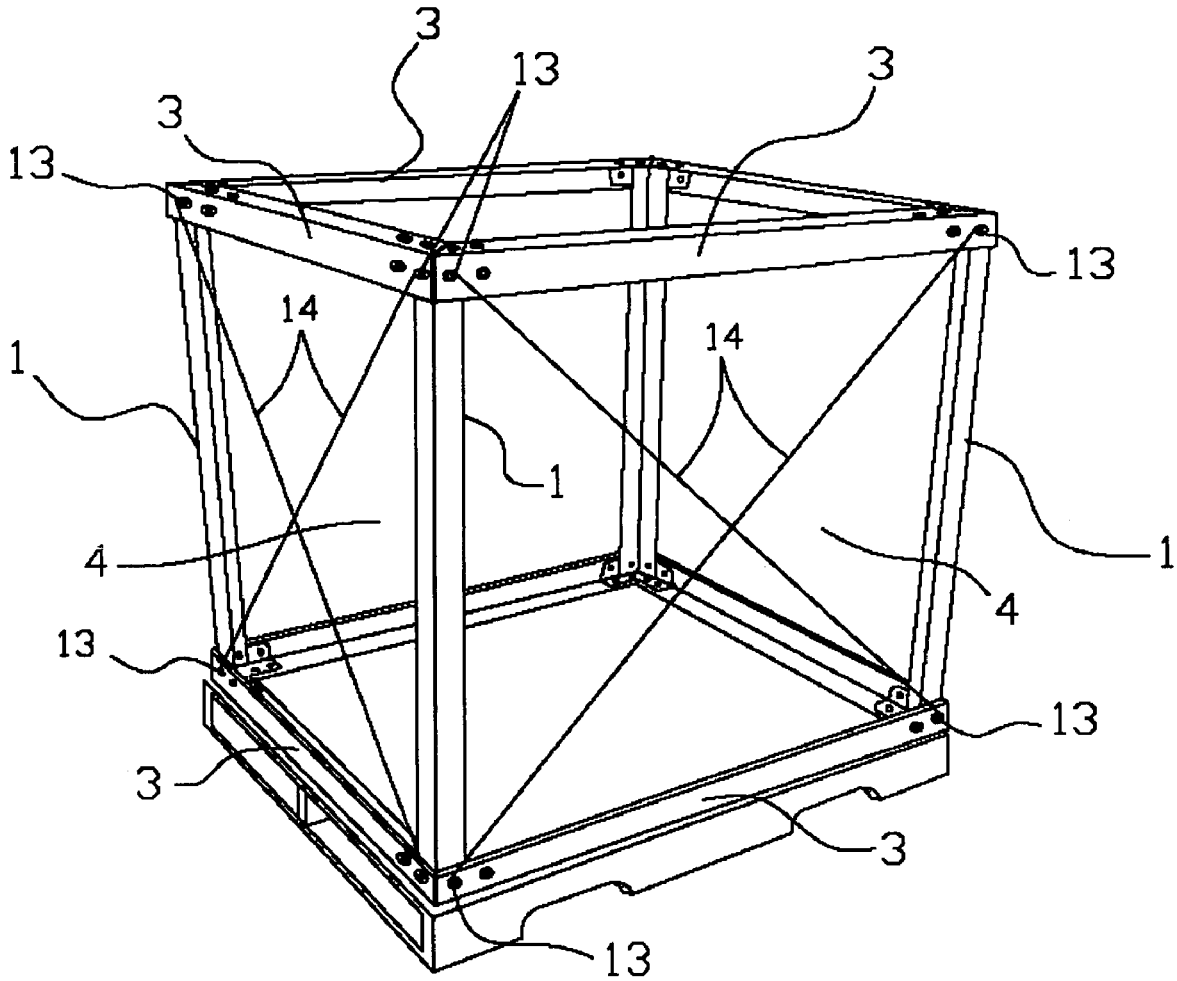
FIG. 4 depicts a conventional perspective view of one embodiment of the packaging structure for containment, transportation, exhibition, and dispensing of products incorporating external tensing strings diagonally set on each face thereof.

With reference now to FIG. 4, the substantially cubical three-dimensional frame comprises on each face (side, front, and back faces) at least two exterior tensing and containing strings 14 (in this example tensing strings are shown only on faces shown in the front in order to avoid confusion in their appreciation if all strings are shown) for products, projecting from one corner to the opposite one on the same face, crossing each other at a medium height of the central section of the empty window 4, ends of such exterior tensing strings 14 are attached to the same fixating means 13 fixating said angular beams 1 and crossbeams 3 on each corner of said three-dimensional frame.

Figure 5:
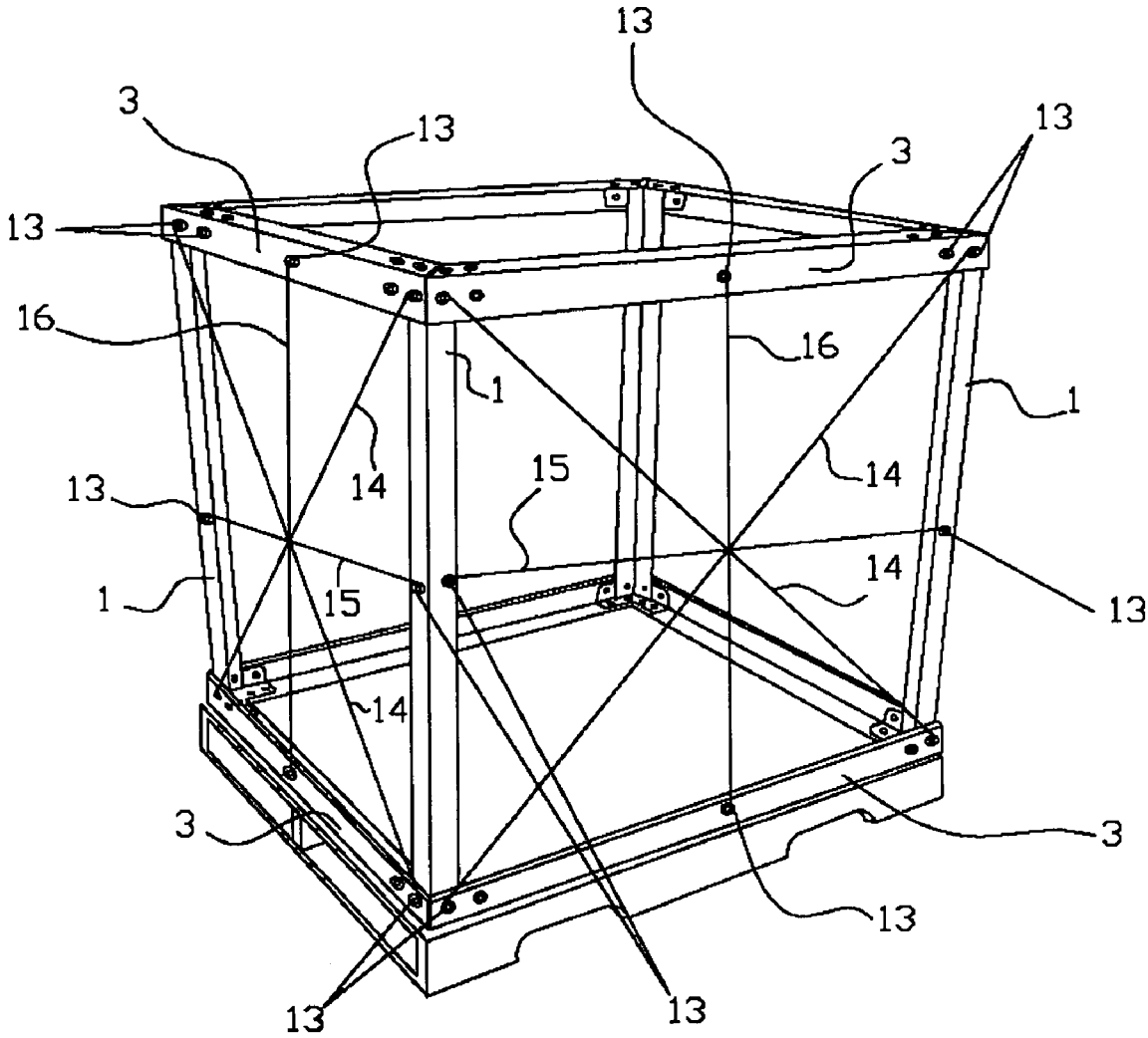
FIG. 5 depicts a conventional perspective view of one embodiment of the packaging structure of this invention incorporating external tensing diagonal, horizontal, and vertical strings set on each face thereof.

With reference now to FIG. 5 depicting a conventional perspective view of another embodiment of the packaging structure of the present invention. In said Figure incorporates, apart from the diagonal exterior tensing strings 14, horizontal exterior tensing strings 15 attached on their ends to opposite angular beams 1 at half their height, crossing each other at the same point as the first two exterior tensing strings, and attached on their ends to other fixating means 13 set on said angular beams 1; it is possible to further incorporate on each lateral, front, and back faces a vertical exterior tensing string 16 whose ends are attached to opposite angular crossbeams 3 halfway through their longitudinal sections, crossing at the same intersection point of all other exterior tensing strings, diagonal 14 and horizontal 15, attached on their ends to other fixating means 13 set on said angular crossbeams 3.

With reference now to FIGS. 6 and 7, the package subject of the present invention comprises at least one pair of interior tensing strings 17, each string is attached on its ends at the required height on angular beams 1 of opposite corners and crossing each other, which render structural stability to the beams; said inner tensing strings 17 can be more than one pair, and may set between each bed of products, each string is attached on its ends at the required height to angular beams 1 on opposite corners and crossing each other, divisional panels 18 are then set on such strings in order to reduce weight of product 19 on said beds, and avoid having the immediate lower bed of products supporting products from the immediate higher bed, so said immediate higher bed of products is supported by such divisional panel 18 and said inner tensing strings 17.

Ends of said inner tensing strings 17 go through holes 20 made on the angular beams 1 and comprising external washers 21 that keep such holes from getting bigger and said strings' ends are knotted, and therefore tensed.

Figure 8:
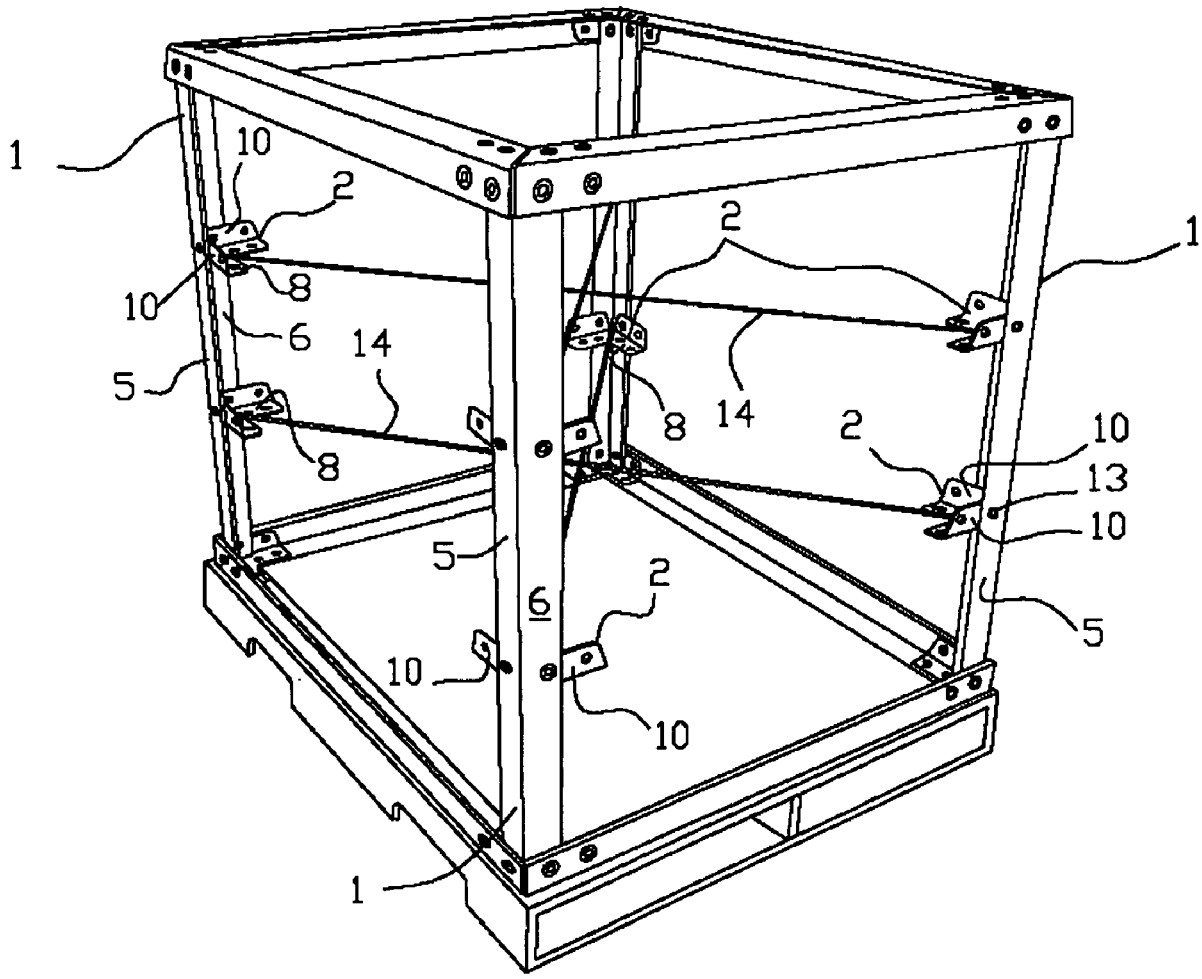
FIG. 8 depicts a conventional perspective view of another embodiment of the packaging structure of this invention, incorporating a plurality of structural corner joints on said angular beams for support of corners of said divisional panels of the product's beds.

With reference now to FIG. 8 depicting a conventional perspective view of another embodiment of the packaging structure of the present invention. In said Figure each beam 1 comprises a plurality of angular structural corner joints 2 attached with fixating means 13 to the arms 5 and 6 of the structural beams 1 through the perpendicularly upward projecting tabs 10, hence the square shaped flat surface section 8 is set as support means for the corners of said divisional panels 18 (not shown) for each bed of stacked products, in order to provide better support thereto in combination with said inner tensing strings, which in this case their knotted ends are captured in the rectangular cavity 12 made exactly on the exterior corner of said orthogonal square 8.

Said plurality of structural corner joints 2 are distributed at different levels, where structural corner joints 2 of each angular beam 1 match the height of corresponding structural corner joints 2 of the other angular beams 3, in order to receive corners of divisional panels 18 (not shown).

Figure 9:
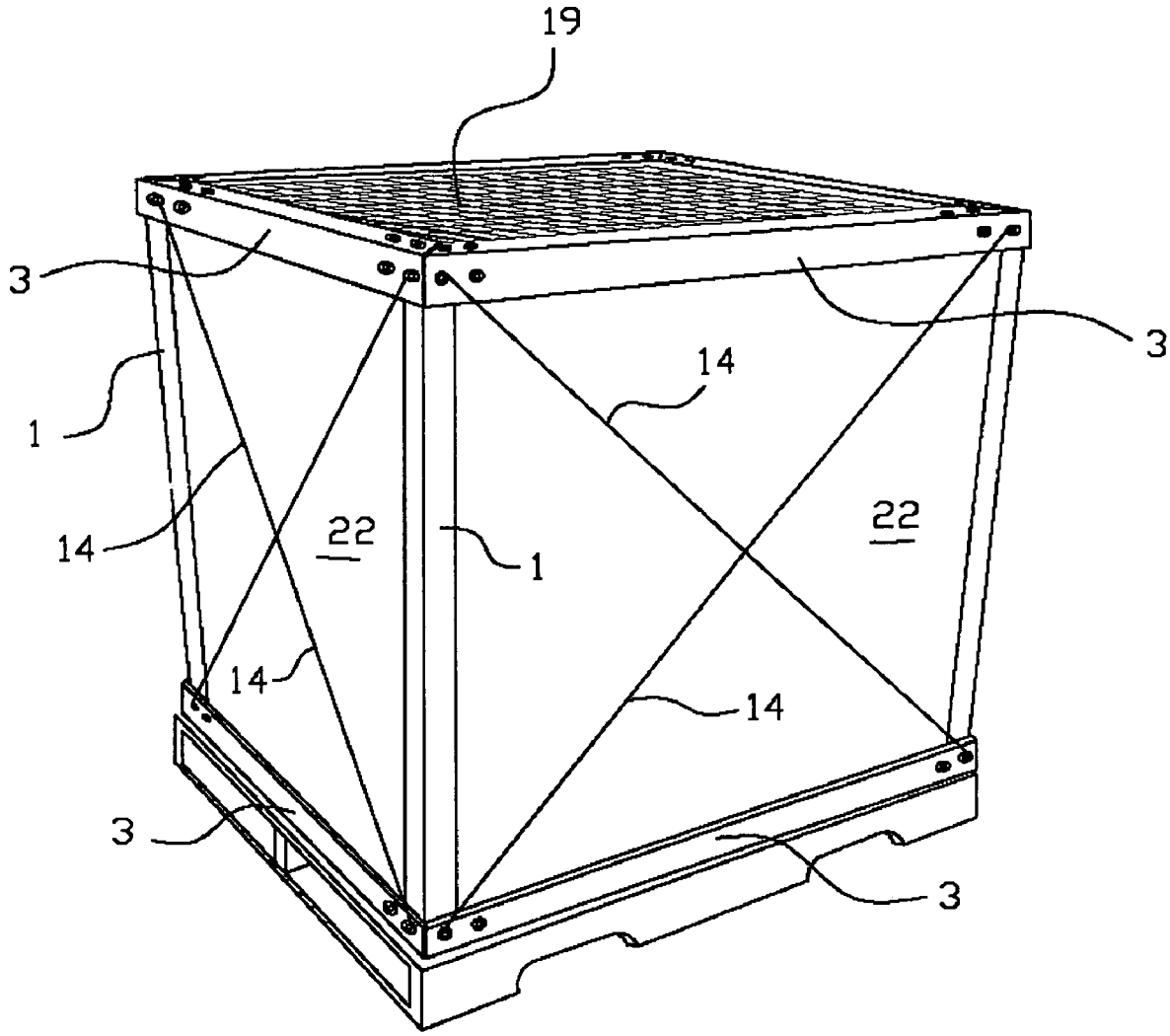
FIG. 9 depicts a conventional perspective view of the package, comprising a lid with promotional covers on each window.

With reference now to FIG. 9, on at least one face of this three-dimensional frame a covering lid 22 is incorporated allowing for diverse advertising to be placed, and will also provide a containing barrier for product 19, said lid is captured between the arms of angular beams 1 and crossbeams 3, further externally supported by diagonal exterior tensing strings 14, and possibly comprising exterior horizontal and diagonal tensing strings (not shown).

This packaging structure, according to this invention, may suffer multiple alterations on these described embodiments, and it is even possible to present a structure where all described embodiments are mixed.

This invention has been described with details enough so that those skilled in the art may reproduce it and get the results stated herein. However, any person skilled in the art of this present invention may do non-described modifications thereto but if the application of such modifications in a given structure or its manufacture process requires the subject matter included in the following claims, such structures shall be included in the scope of this invention.

The invention claimed is:

1. A packaging structure for containing, transportation, exhibition and dispensing of products comprising:

four angular beams arranged in a square or rectangular arrangement;

a plurality of angular crossbeams attaching to the four angular beams at each one of its upper and lower ends to form a three-dimensional frame;

a plurality of structural corner joints, through which each one of the angular crossbeams are attached to two of the four angular beams, wherein each one of said structural corner joints, is comprised of:

an orthogonal square-shaped section with rounded vertex;

a pair of fixing tabs of substantially trapezoidal section which are projected perpendicularly from each external side of the orthogonal square-shaped section;

a plurality of holes in which are housed fixing means to fix said structural corners to the four angular beams and the plurality of angular crossbeams attached thereto; and a rectangular cavity is provided at the external corner of the orthogonal square-shaped section with rounded vertex between the two fixing tabs of the substantially trapezoidal section; and a plurality of tensing strings comprised in each face of the three-dimensional frame formed by the attachment of the plurality of angular crossbeams and the four angular beams, which are projected defining:

external diagonal arrangements, wherein said tensing strings are projected from each one of the corners defined by the attachment of the plurality of angular crossbeams and the four angular beams to the opposite corner on the same face, fixing each one of the ends of said tensing and retaining strings to the rectangular cavity provided in each structural corner joint; and external vertical arrangements wherein said tensing strings are projected from opposite angular crossbeams on one same face, fixing each one of the ends of said tensing strings to each one of said opposite angular crossbeams with fasteners, external horizontal arrangements, wherein said tensing strings are projected from a pair of opposite angular beams in a same face, fixing each one of the ends of said tensing strings to each one of said opposite angular beams; and a plurality of inner tensing strings arrangements at different level, a pair of said tensing strings on each one of its ends attached to a pair of opposite angular beams at the rectangular cavity at same height, so that the strings are crossed each other, providing greater structural stability to the beams and being adapted to provide support for products located directly above the inner tensing strings.

2. A packaging structure for containing, transportation, exhibition and dispensing of products comprising:

four angular beams arranged in a square or rectangular arrangement;

a plurality of angular crossbeams attached to the four angular beams at each one of its upper and lower ends to form a three-dimensional frame;

a plurality of structural corner joints, through which it is attached each one of the angular crossbeams to two of the four angular beams, wherein each one of said structural corner joints is comprised of:

an orthogonal square-shaped section with rounded vertex;

a pair of fixing tabs of section substantially trapezoidal, which are projected perpendicularly from each external side of the orthogonal square-shaped section;

a plurality of holes in which are housed fixing means to fix said structural corners to the four angular beams and the plurality of angular crossbeams attached thereto, and a rectangular cavity provided the external corner of said orthogonal square-shaped section with rounded vertex between the two fixing tabs of the substantially trapezoidal section, and a plurality of structural corner joints, which are fixed with fasteners at different levels to each one of the four angular beams, defining each one of said structural corner joints, supporting means attached at rectangular cavity for a plurality of divisional panels on which are defined beds of stacked products, wherein each one of said structural corner joints, is comprised of:

an orthogonal square-shaped section with rounded vertex;

a pair of fixing tabs of section substantially trapezoidal, which are perpendicularly projected from each external face of the orthogonal square-shaped section;

a plurality of holes in which are housed fixing means to fix said structural corners to each one of the four angular beams, and said rectangular cavity provided at the external corner at said orthogonal square-shaped section with rounded vertex between the two fixing tabs of section substantially trapezoidal.

3. The structure of claim 2, wherein the angular beams and the angular crossbars made of compressed hard cardboard.

4. The structure of claim 2, wherein at least one face of the three-dimensional frame formed by the attachment of the plurality of angular crossbeams and the four angular beams, it is incorporated a covering lid that is used as a product containing barrier, the lid being captured between the arms of the angular beams and angular crossbeams, further externally supported by the external tensing strings.

* * * * *